US005948529A

United States Patent [19]

Hastie

[11] Patent Number: 5,948,529

[45] Date of Patent: Sep. 7, 1999

[54] BICOMPONENT FIBER

[75] Inventor: Allan J. Hastie, Charlotte, N.C.

[73] Assignee: HNA Holdings, Inc., Charlotte, N.C.

[21] Appl. No.: 09/028,737

[22] Filed: Feb. 24, 1998

Related U.S. Application Data

[60] Provisional application No. 60/806,992, Feb. 26, 1997, abandoned.

[51] Int. Cl.[6] ..... D02G 3/00

[52] U.S. Cl. ..... 428/373; 428/370

[58] Field of Search ..... 428/370, 373, 428/374

[56] References Cited

U.S. PATENT DOCUMENTS 5,167,765 12/1992 Nielsen et al. ..... 162/146
5,346,963 9/1994 Hughes et al. ..... 525/285
5,364,694 11/1994 Okada et al. ..... 428/288
5,372,885 12/1994 Tabor et al. ..... 428/373

FOREIGN PATENT DOCUMENTS 0 311 860 B1 7/1996 European Pat. Off. .

*Primary Examiner*—Newton Edwards
*Attorney, Agent, or Firm*—Gregory N. Clements

[57] ABSTRACT

A bicomponent staple or filament is disclosed having a core of PET and a sheath of polyethylene wherein the core PET component contains from 0.5 wt % to 10 wt % of a functionalized polyethylene polymer specified herein. In particular, the sheath component is either not functionalized or functionalized with up to 10% by weight ethylene copolymer. The improved bicomponent fiber is processible on carding machines with reduced shedding of the outer portion of the fiber.

9 Claims, No Drawings

BICOMPONENT FIBER

This application claims the benefit of U.S. Provisional Application 60/806,992 filed Feb. 26, 1997 now abandoned.

FIELD OF THE INVENTION

The present invention relates to a bicomponent fiber having a polyethylene terephthalate (PET) core and a sheath. Specifically, the PET core contains a minor amount of a functionalized ethylene copolymer from 0.01 wt % to 10 wt % based on the weight of the core polymer. More specifically, the sheath can be an ethylene homopolymer or an ethylene copolymer and optionally contain 0.01 wt % to 10 wt % based on total weight of the sheath polymer of a compound containing both ethylene unsaturation and a carboxyl group. The ethylene polymer sheath can be low density polyethylene (LDPE), linear low density polyethylene (LLDPE) or high density polyethylene (HDPE).

BACKGROUND OF THE INVENTION

Combinations of graft modified polyethylene and another polyolefin are known. European Patent Applications 0 465 203 and 0 311 860 disclose bicomponent fibers having a polyester or polyamide core and a sheath component consisting of either a blend of graft-modified polyethylene with homo-polyethylene or a copolymer straight-chain low density polyethylene copolymer. Suggested uses are in making carded, heat bonded nonwoven fabric. The ethylene copolymer of EP '860 is defined as consisting of ethylene and at least one member selected from the class consisting of an unsaturated carboxylic acid and a derivative from said carboxylic acid and a carboxylic acid and a carboxylic acid anhydride.

GB-A-2 125 458 discloses a thermally bonded fibrous web consisting essentially of a bicomponent fiber comprising a polyester or polyamide component and a second component consisting essentially of a linear low density polyethylene having a density in the range of 0.910 to 0.940 g/cc. The web may also include a matrix fiber. Bicomponent fibers having a core of PET and a sheath of a blend of a polyolefin homopolymer and graft-modified polyethylene are commercially available from Hoechst Celanese Corp. under the CELBOND trademark, for example CELBOND T-255.

Experience has shown that core-sheath adhesion is a problem with bicomponent fibers of a PET core/polyolefin sheath. This is not surprising since polyethylene and PET are mutually incompatible.

More specifically, experience with a bicomponent staple fiber of LLDPE-sheath/PET-core configuration has shown shedding of the outer portion of the fiber apparently due to action of the carding wires when processed on carding machines.

There remains a need to develop a staple fiber useful for thermally bonded fibrous webs providing an improved heat fusible bicomponent fiber which will not only increase the strength of the web, but also avoid the shedding problem associated with the outer portion of the fiber in carding machines.

SUMMARY OF THE INVENTION

In accordance with the invention, there is provided in one aspect, a bicomponent staple or filament having a core of PET and a sheath of one or more types of polyethylenes, wherein the core PET component contains from 0.01 wt % to 10 wt % of a functionalized ethylene copolymer. The functionalized ethylene copolymer in the core helps adhere the sheath to the core of the bicomponent fiber. The sheath component may also be functionalized with up to 10% by weight of the ethylene copolymer, or it may contain unfunctionalized ethylene copolymer.

The PET core always contains the functionalized ethylene copolymer. The polyethylene sheath may contain one or more of HDPE, LDPE or LLDPE, and may also contain the functionalized ethylene copolymer. The functionalized ethylene copolymer may be HDPE, LDPE or LLDPE, or a combination of these, with a carboxyl compound or carboxyl derivative compound. Thus the sheath could contain, for example, HDPE plus the carboxyl or carboxyl derivative compound, while the PET core could also contain HDPE plus the carboxyl or carboxyl derivative compound. The following table illustrates the various combinations.

| Core | Sheath |
|---|---|
| PET plus 0.51–10% of HDPE or LDPE or LLDPE or a mixture of these with carboxyl compound or a carboxyl derivative compound | HDPE or LDPE or LLDPE or a mixture of these optionally with carboxyl compound or a carboxyl derivative compound |

Thus the possibilities are, in the core, PET+8 different functionalized ethylene copolymer, in combination with 12 different sheath components, only four of which are not functionalized (without carboxyl or carboxyl derivative compounds). The carboxyl or carboxyl derivative compound is generally grafted into the polyethylene, but other methods of preparation are also within the scope of the present invention.

Functionalized ethylene copolymer is defined herein as a graft-modified ethylene polymer or a polymerized ethylene copolymer containing a co-polymerized carboxyl group (or derivative of a carboxyl group) containing comonomer.

A Description of the Preferred Embodiments

Functionalized ethylene copolymers for use in the present invention are available from a variety of commercial sources including Dow Chemical, Midland Mich. The most preferred functionalized ethylene copolymer is sold under the ASPUN trademark of DOW CHEMICAL USA. These graft-modified, substantially linear ethylene polymers are taught in U.S. Pat. Nos. 4,394,485; 4,460,632; 4,460,745; 4,487,885; 4,950,451; and 5,346,963 which are hereby incorporated by reference.

Functionalized ethylene copolymers contain carboxyl groups present as pendant groups on the backbone or pendant from comonomers incorporated into the polyethylene backbone. Functionalized ethylene copolymer herein means that there is from 0.5 mole % to 50 mole % of a compound having at least one carboxyl group, or at least one derivative of the carboxyl group such as an ester, an anhydride, or a salt.

The functionalized ethylene copolymer may also be a functionalized linear polyethylene, e.g. low density polyethylene (LDPE), linear low density polyethylene (LLDPE), high density polyethylene (HDPE), with the carboxyl compound or carboxyl derivative compound. Such polymers are termed "linear" because of the substantial absence of branched chains of polymerized monomer units pendant from the main polymer "backbone". In one embodiment, there is a linear ethylene polymer wherein ethylene has been copolymerized along with minor amounts of alpha, beta-ethylenically unsaturated alkenes having from 3 to 12 carbons per alkene molecule, preferably 4 to 8. The amount of the alkene comonomer for this one embodiment is generally sufficient to cause the density of the polymer to be substantially in the same density range of LDPE, due to the alkyl side chains on the polymer molecule, yet the polymer remains in the "linear" classification; they are included in the definition of linear low density polyethylene herein.

The substantially linear ethylene polymers used as functional ethylene polymer used in the PET, as well as, polyethylene used in the sheath in this invention are known, and their method of preparation is fully described in U.S. Pat. No. 5,272,236 and U.S. Pat. No. 5,278,272, both of which are incorporated herein by reference. As here used, "substantially linear" means that the polymer backbone is substituted with about 0.01 long-chain branches/1000 carbons to about 3 long-chain branches/1000 carbons, preferably from about 0.01 long-chain branches/1000 carbon to about 1 long-chain branch/1000 carbons, more preferably from about 0.05 long-chain branches/1000 carbons to about 1 long-chain branch/1000 carbons. Long-chain branching is here defined as a chain length of at least about 6 carbon atoms, above which the length cannot be distinguished using $C_{13}$ nuclear magnetic resonance spectroscopy, yet the long-chain branch can be about the same length as the length of the polymer backbone. These unique polymers (subsequently referred to as "substantially linear ethylene polymers") are prepared by using constrained geometry catalysts (substantially linear ethylene), and are characterized by a narrow molecular weight distribution and if an interpolymer, by a narrow comonomer distribution. As here used, "interpolymer" means a polymer of two or more comonomers, e.g., a copolymer, terpolymer, etc., or in other words, a polymer made by polymerizing ethylene with at least one other comonomer. Other basic characteristics of these substantially linear ethylene polymers include a low residuals content (i.e., low concentrations in the substantially linear ethylene polymer of the catalyst used to prepare the polymer, unreacted comonomers and low molecular weight oligomers made during the course of the polymerization), and a controlled molecular architecture which provides good processability even though the molecular weight distribution is narrow relative to conventional olefin polymers. While the substantially linear ethylene polymers used in the practice of this invention include substantially linear ethylene homopolymers, preferably the substantially linear ethylene polymers used in the practice of this invention can be copolymers comprising between about 95 and 50 weight percent (wt %) ethylene, and about 5 and 50 wt % of at least one (α-olefin comonomer, more preferably 10 to 25 wt % of at least one a-olefin comonomer. The alpha olefin comonomer content is measured using infrared spectroscopy according to ASTM D-2238 Method B. Typically, the substantially linear ethylene polymers are copolymers of ethylene and an α-olefin of 3 to about 20 carbon atoms (e.g., propylene, 1-butene, 1-hexene, 4-methyl-1-pentene, 1-heptene, 1-octene, styrene, etc.), preferably of 3 to about 10 carbon atoms, and more preferably these polymers are a copolymer of ethylene and 1-octene.

The base polyethylene polymer used to make the preferred functionalized ethylene copolymer herein is characterized as LLDPE having a melt index in the range of about 0.5 g/10 min to about 200 g/10 min according to ASTM D-1238(E) at 190° C. and a density in the range of about 0.92 g/cc to about 0.965 g/cc, preferably a MFV about 7 gms/10 min to about 10 gms/10 min and a density of about 0.950 g/cc to about 0.960 b/cc. The anhydride or acid groups generally comprise about 0.0001 to about 50 wt. percent, preferably about 0.01 to about 5 wt. percent of the LLDPE. The preferred functionalized ethylene copolymer is a graft modified linear low density polyethylene having a melt index of from 6 to 25 and a density of from 0.92 to 0.955.

Any unsaturated organic compound containing at least one ethylenic unsaturation (e.g., at least one double bond), and at least one carbonyl group (—C═O), that will graft to a substantially linear ethylene polymer as described above can be used in the practice of this invention. Representative of compounds that contain at least one carbonyl group are the carboxylic acids, anhydrides, esters and their salts, both metallic and nonmetallic. Preferably, the organic compound contains ethylenic unsaturation conjugated with a carbonyl group. Representative compounds include maleic, fumaric, acrylic, methacrylic, itaconic, crotonic, a-methyl crotonic, and cinnamic acid and their anhydride, ester and salt derivatives, if any. Maleic anhydride is the preferred unsaturated organic compound containing at least one ethylenic unsaturation and at least one carbonyl group.

The unsaturated organic compound content of the functionalized ethylene polymer in the grafted embodiment polymer is at least about 0.01 wt %, and preferably at least about 0.05 wt %, based on the combined weight of the polymer and the organic compound. The maximum amount of unsaturated organic compound content can vary to convenience, but typically it does not exceed about 10 wt %, preferably it does not exceed about 5 wt %, and most preferably is about 2 wt %.

The unsaturated organic compound can be grafted to the substantially linear ethylene polymer by any known means such as by the method of U.S. Pat. Nos. 3,236,917 and 5,194,509 both of which are incorporated by reference.

The preferred method of grafting is taught in U.S. Pat. Nos. 4,394,485 or 4,460,632 or 4,460,745 or 4,487,885 or 4,950,541, the disclosure of each is incorporated into and made a part of this application by reference. Specifically, the method is achieved, by using a twin-screw devolatilizing extruder as the mixing apparatus. The substantially linear ethylene polymer and unsaturated organic compound are mixed and reacted within the extruder at temperatures at which the reactants are molten and in the presence of a free radical initiator. Preferably, the unsaturated organic compound is injected into a zone maintained under pressure within the extruder.

Alternatively the functionalized ethylene copolymer is formed by copolymerizing ethylene with an unsaturated carboxylic acid, or derivative from said carboxylic acid, or a carboxylic acid anhydride. Exemplary comonomers are unsaturated carboxylic acids, such as acrylic acid and methacrylic acid; acrylic esters, such as methyl acrylate, ethyl acrylate, butyl acrylate, 2-ethylhexyl acrylate, and 2-hydroxyethyl acrylate; methacrylate; and unsaturated carboxylic acid anhydrides, such as maleic acid anhydride and itaconic acid anhydride. The functionalized ethylene copolymer specified herein contains one or more such comonomers; thus, these comonomers may be suitably combined. Further, the functionalized ethylene copolymer herein may be a copolymerisate of ethylene and said carboxylic acid compound in alternate, random or block form or mixture of such forms. The ratio of the comonomer mole to ethylene is restricted to 0.1–5.0 percent with respect to ethylene from the standpoint of physical properties of the copolymer ethylene. In the case where the copolymerization ratio is less than 0.1 mole percent, the adhesion of the PET matrix component is low, with the result that in carding fibers to form a nonwoven fabric the shedding problem recurs. On the other hand, if the copolymerization ratio is Treater than 5.0 mole percent, the melting point or softening point of the PET becomes extremely low, which is not desirable from the standpoint of strength, and heat resistance of a fabric formed therefrom.

The preferred functionalized ethylene copolymer is a substantially linear low density polyethylene comprising: a substantially linear ethylene copolymer grafted with at least 0.01 wt %, based on the weight of the grafted ethylene copolymer, of an unsaturated organic compound containing at least one ethylenic unsaturation and at least one carboxyl group or at least one derivative of the carboxyl group selected from the group consisting of an ester, an anhydride and a salt.

In one embodiment the functionalized ethylene copolymer is a graft-modified high density polyethylene (HDPE), wherein the HDPE has been grafted with maleic acid or maleic anhydride, thereby providing succinic acid of succinic anhydride groups grafted along the polymer chain. Other compounds containing both ethylene unsaturation and a carboxyl group can likewise be employed with a polyethylene.

The most preferred functionalized ethylene copolymer is a LLDPE containing 1.2% grafted maleic anhydride, has a melt index of 12, a density of 0.953 and is commercially available from DOW chemical, Midland, Mich. under the ASPUN trademark.

The sheath polymer used in the invention can be a homopolymer, but is preferably an ethylene copolymer with a minor proportion of unsaturated alkene comonomer. The sheath polymer may have a density in the range of about 0.89 g/cc to about 0.97 g/cc, preferably about 0.93 g/cc to about 0.96 g/cc. It is evident to practitioners of the relevant arts that the density of the sheath polymer will depend, in large part, on the particular alkene(s) incorporated into the polymer. The preferred polyethylene sheath polymer comprises a minor amount of at least one unsaturated alkene of the form C3–C12, most preferably from C4–C8,and 1-octene is especially preferred. The amount of said alkene may constitute about 0.5% to about 35% by weight of the sheath polymer, preferably about 1% to about 20%, most preferably about 1% to about 10%. The LLDPE for use in the present invention is a normally solid, high molecular weight polymer prepared using a coordination-type catalyst in a process wherein ethylene is homopolymerized. The melt index value of the sheath polyolefin can range from 5 to 50 g/10 minutes as measured by ASTM D-1238(E). In the case of the LLDPE copolymer whose melt index is less than 1 g/10 minutes, the fluidity associated with melt spinning is degraded to the extent that a bicomponent fiber cannot be produced unless the spinning speed is drastically decreased.

Typical Fiber Spinning Method

A PET core/sheath (LDPE, LLDPE, HDPE) is melt spun in core/sheath configuration on a commercially available bicomponent spinner. The PET core is dried at 150° C. under vacuum. The polyethylene sheath is loaded into the sheath extruder, generally without drying. A screw feeder (e.g., auger) feeds the functionalized polyethylene polymer at a predetermined rate to the throat of the core extruder and/or the sheath extruder. The core extruder melt temperature is maintained at about 280° C. The PET and functionalized polyethylene polymer are therefore mixed in the core extruder. Likewise if the sheath contains functionalized polyethylene polymer, it is mixed in the sheath extruder. The sheath extruder melt temperature is maintained at about 250° C. Bicomponent filaments that are formed are quenched with air at about 35° C., treated with a spin finish, and taken up through godets, to a can, or to a winder.

The spun yarn from the bicomponent spinner is then taken to the drawing stage. The yarn from the cans or winder bobbins are drawn between a bank of rolls at about 68° C. using heat and conventional drawing finish as drawing aids. The drawn yarn is passed over some heat setting rolls at about 105° C., crimped through a stuffer box and then dried in an oven at about 110° C. The crimped yarn is then typically applied with a conventional finish for downstream processing, cut to staple fiber length (⅛"–7") and baled.

Core sheath ratios (weight basis) range from 25% to 75% for the core and 25% to 75% for the sheath, together totaling 100%. The PET core is commercially available, conventional polyethylene terephthalate (PET) for example, from Hoechst North America, Charlotte, N.C. PET usable herein generally has an I.V. of from 0.4 to 1.00 (measured in orthochlorophenol) at standard conditions.

EXAMPLE AND COMPARISON

Two samples of 3 dpf (denier per filament) bicomponent staple fibers were produced. The first sample, designated the control, had a sheath core configuration using PET as the core and LLDPE as the sheath, 50% each by weight. The second sample, designated the improved fiber, had a sheath core configuration using PET as the core and LLDPE as the sheath, 50% each by weight. However, both the core and the sheath of the second sample contained 2% weight of the functionalized adhesive, namely a blend of 1% by weight maleic anhydride grafted on to a polyethylene (generally a high density polyethylene —99% by weight). Both samples were then tested by the same procedure. Each sample was blended with a 6 dpf commodity PET staple fiber at a 75/25 ratio (bico to PET) and 4 oz. of the blend were carded twice on a lab card. Fallout and debris were collected under the card on black hardboard only during the second pass. Fallout comprising loose fibers was separated from the debris on the hardboard. The debris left on the two black hardboards were then visually ranked. The improved fiber containing the functionalized adhesive produced significantly less debris than the control fiber. It was determined that the debris consisted primarily of pieces of sheath material separated from the core.

Thus it is apparent that there has been provided, in accordance with the invention, a biocomponent fiber that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A bicomponent fiber having a weight proportion of a core component and a weight proportion of a sheath component, comprising:

a core polymer of a blend of PET and functionalized ethylene copolymer, and a sheath polymer comprising polyethylene polymer.

2. The bicomponent fiber of claim 1, wherein said functionalized ethylene copolymer is a graft modified polyethylene including, LDPE, LLDPE, and HDPE having a melt index of from 6 to 25 and a density of from 0.89 to 0.97 g/cc.

3. The bicomponent fiber of claim 1, wherein said weight proportion of said core polymer is from 25% to 75% and the weight proportion of said sheath polymer is from 25% to 75%, wherein the total for the bicomponent fiber is 100%.

4. The bicomponent fiber of claim 1, wherein said functionalized ethylene copolymer is selected from the group consisting of a graft-modified polyethylene, or a copolymer of ethylene, with an unsaturated carboxylic group containing conomer.

5. The bicomponent fiber of claim 4, wherein said graft-modified polyethylene comprises:

polyethylene polymer grafted with at least about 0.01 wt %, based on the weight of the grafted ethylene polymer, of an unsaturated organic compound containing at least one ethylenic unsaturation and at least one carboxyl group or at least one derivative of the carboxyl group selected from the group consisting of an ester, an anhydride or a salt.

6. The bicomponent fiber of claim 1, wherein said functionalized ethylene copolymer is present in an amount of 0.01–10 wt % based on the weight of said core polymer.

7. The bicomponent fiber of claim 1, wherein said sheath polymer is ethylene homopolymer.

8. The bicomponent fiber of claim 1, wherein said sheath polymer is an ethylene copolymer with a minor portion of unsaturated alkene comonomer.

9. The bicomponent fiber of claim 8, wherein said ethylene copolymer contains from 0.5–35% by weight unsaturated alkene based on the total weight of said sheath polymer.

* * * * *